US007372412B2

(12) United States Patent
Koide

(10) Patent No.: US 7,372,412 B2
(45) Date of Patent: May 13, 2008

(54) TRANSCEIVER-INTEGRATED ANTENNA

(75) Inventor: Shirou Koide, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/184,711

(22) Filed: Jul. 19, 2005

(65) Prior Publication Data

US 2006/0017646 A1 Jan. 26, 2006

(30) Foreign Application Priority Data

Jul. 21, 2004 (JP) ..... 2004-212927

(51) Int. Cl.
*H01Q 1/24* (2006.01)

(52) U.S. Cl. ..... 343/702

(58) Field of Classification Search ..... 343/702, 343/700 MS, 786, 860, 878
See application file for complete search history.

(56) References Cited

U.S. PATENT DOCUMENTS 4,771,294 A * 9/1988 Wasilousky ..... 343/853
5,023,624 A * 6/1991 Heckaman et al. ..... 343/860
5,694,136 A * 12/1997 Westfall ..... 343/700 MS
5,886,668 A * 3/1999 Pedersen et al. ..... 343/702
5,982,333 A * 11/1999 Stillinger et al. ..... 343/766
6,023,245 A * 2/2000 Gomez et al. ..... 343/725
6,512,482 B1 * 1/2003 Nelson et al. ..... 343/700 MS
6,515,627 B2 * 2/2003 Lopez et al. ..... 343/700 MS
6,531,985 B1 * 3/2003 Jones et al. ..... 343/702
6,580,402 B2 * 6/2003 Navarro et al. ..... 343/853
6,995,715 B2 * 2/2006 Ying et al. ..... 343/702

FOREIGN PATENT DOCUMENTS

JP 2002-111377 4/2002

* cited by examiner

*Primary Examiner*—Huedung Mancuso
(74) *Attorney, Agent, or Firm*—Harness, Dickey & Pierce, PLC

(57) ABSTRACT

The transceiver-integrated antenna includes an antenna element, a ground plate for grounding the antenna element, and a transceiver configured to transmit and receive radio signals through the antenna element. The transceiver is housed in a recess formed in the ground plate. The ground plate serves as not only a plane for grounding the antenna element, but also a radiator for dissipating the heat emitted from the transceiver.

13 Claims, 2 Drawing Sheets

TRANSCEIVER-INTEGRATED ANTENNA

CROSS-REFERENCE TO RELATED APPLICATION

This application is related to Japanese Patent Application No. 2004-212927 filed on Jul. 21, 2004, the contents of which are hereby incorporated by reference.

BACKGROUND OF THE INVENTION

1. Field of the Invention

The present invention relates to a transceiver-integrated antenna including an antenna element, and a transceiver which is integrated to the antenna element and configured to transmit and receive radio signals through the antenna element.

2. Description of Related Art

As described, for example, in Japanese Patent Application Laid-open No. 2002-111377, it is known to use an integrated antenna including a plurality of different antenna elements used for different radio communication systems for the purpose of saving antenna installation space. It is also known to use a transceiver-integrated antenna including an antenna element and a transceiver for the purpose of saving antenna installation space, and also reducing transmission loss between the antenna element and the transceiver.

However, conventional transceiver-integrated antennas have a problem in that their production costs are high, because they must have a heat radiating member (or heat radiation fin) for dissipating the heat emitted from the transceiver in addition to a ground plate, which inevitably increases the number of parts.

SUMMARY OF THE INVENTION

The present invention provides a transceiver-integrated antenna having a structure including:

an antenna element;

a ground plate for grounding the antenna element; and a transceiver configured to transmit and receive radio signals through the antenna element, wherein the transceiver is housed in a recess formed in the ground plate.

The present invention also provides a transceiver-integrated antenna having a structure including:

a first antenna element;

a second antenna element connectable to one of an external receiver and an external transceiver;

a ground plate for grounding the first and second antenna elements; and a transceiver configured to transmit and receive radio signals through the first antenna element, wherein the transceiver is housed in a recess formed in the ground plate.

In each of the above described structures, the ground plate serves as not only a plane for grounding the antenna element (s), but also a radiator for dissipating the heat emitted from the transceiver. Accordingly, with the present invention, the vehicle-installed integrated antenna can be constituted by a smaller number of parts, thereby reducing the production costs thereof. Furthermore, with the present invention, it is possible to prevent the noise emitted from the transceiver from leaking to the outside, because the transceiver can be housed in a shielded state.

PREFERRED EMBODIMENTS OF THE INVENTION

Figure 1:
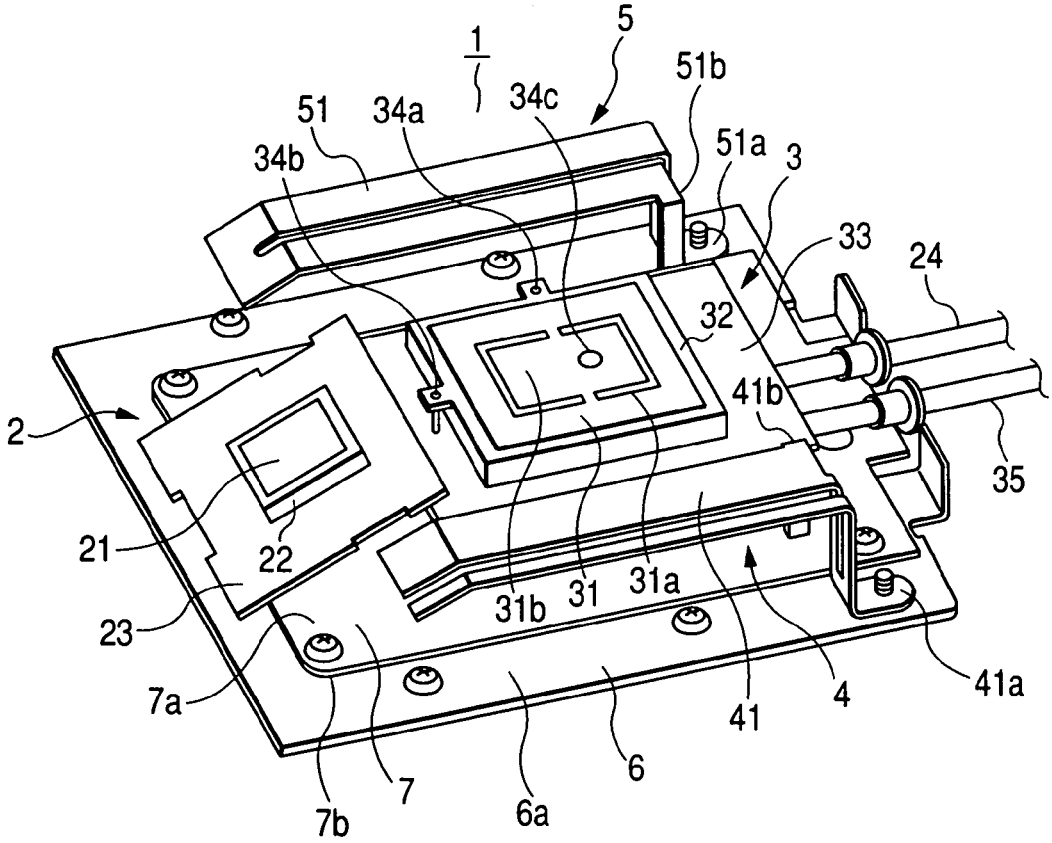
FIG. 1 is a perspective view of a vehicle-installed integrated antenna according to an embodiment of the invention.

FIG. 1 is a perspective view of a vehicle-installed type transceiver-integrated antenna 1 (referred to as vehicle-installed integrated antenna 1, or integrated antenna 1 hereinafter) according to an embodiment of the invention viewed from above. This integrated antenna 1 includes an antenna element 2 for the ETC (Electronic Toll Collection system), an antenna element 3 for GPS (Global Positioning System)/VICS (Vehicle Information Communications System), and telephone antenna elements 4 and 5 for the automobile telephone system.

The ETC antenna element 2 is constituted by an ETC circuit board 23, a rectangular parallelepiped dielectric 22 mounted on the ETC circuit board 23, and a rectangular electrode 21 formed on the dielectric 22.

The ETC antenna element 2 is connected to one end of a coaxial cable 24 the other end of which is connected to an ETC connector (not shown) connectable to an ETC transceiver (not shown). The ETC antenna element 2 is installed such that its antenna surface (the surface of the electrode 21) inclines at an angle of about 23 degrees to horizontal, because the arrival direction of the electromagnetic wave inclines at an angle of about 23 degrees from the zenith direction in the ETC.

The GPS/VICS antenna element 3 can serve as a GPS antenna element and as a VICS antenna element, because of its structure including a ground plate 33, a rectangular parallelepiped dielectric 32 mounted on the ground plate 33, and a rectangular electrode 31 having an outer portion 31*a* and an inner portion 31*b* and mounted on the dielectric 32. The ground plate 33 is in electrical contact with the ground plate 6 in terms of radio frequency by capacitive coupling therebetween.

A GPS/VICS circuit board (not shown) is mounted on the rear surface of the ground plate 33. The outer portion 31*a* of the electrode 31 serves as an antenna electrode for the GPS, and the inner portion 31*b* of the electrode 31 serves as an antenna electrode for the VICS. The outer portion 31*a* is fed through feeding points 34*a* and 34*b*, while the inner portion 31*b* is fed through a feeding point 34*c*.

The GPS/VICS antenna element 3 is connected to one end of a coaxial cable 35 the other end of which is connected to a GPS/VICS connector (not shown) connectable to a GPS/VICS receive (not shown). The GPS/VICS antenna element 3 is installed such that its antenna surface (the surface of the electrode 31) is parallel to horizontal, because the arrival directions of the electromagnetic waves are parallel to the zenith direction in the GPS and VICS.

The role of the dielectrics 22, 32 is to mechanically support the electrodes 21, 31, respectively, and to provide the wavelength reduction effect. By using a material having high dielectric constant for these dielectrics 22, 32, it becomes possible to downsize the electrodes 21, 31, thereby compacting the vehicle-installed integrated antenna 1. The dielectrics 22, 32 may be made of a ceramic or a resin containing a base material having a low radio-frequency loss, such as the PPS (polyphenylene sulfide).

The telephone antenna element 4, which serves as a main antenna element for the automobile telephone system, includes a folded conductive bar plate 41 (transmission line member). The conductive plate 41 is grounded (screwed) to the ground plate 6 at one end 41*a* thereof.

The conductive bar plate 41 is fed by a telephone transceiver 8 secured to a rear surface 7*b* of a circuit board 7 through a feeding portion 41*b* thereof. The length of the conductive bar plate 41 is about the same as a quarter of a wavelength of an electromagnetic wave to be received or transmitted.

The telephone antenna element 5, which serves as a sub antenna element for the automobile telephone system, includes a folded conductive bar plate 51 (transmission line member). The conductive bar plate 51 is grounded (screwed) to the ground plate 6 at one end 51*a* thereof. The conductive bar plate 51 is fed by the telephone transceiver 8 through a feeding portion 51*b* thereof. The length of the conductive bar plate 51 is about the same as a quarter of the wavelength of the electromagnetic wave to be received or transmitted.

The circuit board 7 has, on its front surface 7*a*, electronic components for processing transmit signals to be supplied to the telephone transceiver 8 and receive signals supplied from the telephone transceiver 8. The circuit board 7 has also a mount or mounts (not shown) for fixing the antenna elements 2, 3, 4, 5 on the front surface 7*a*.

Figure 2:
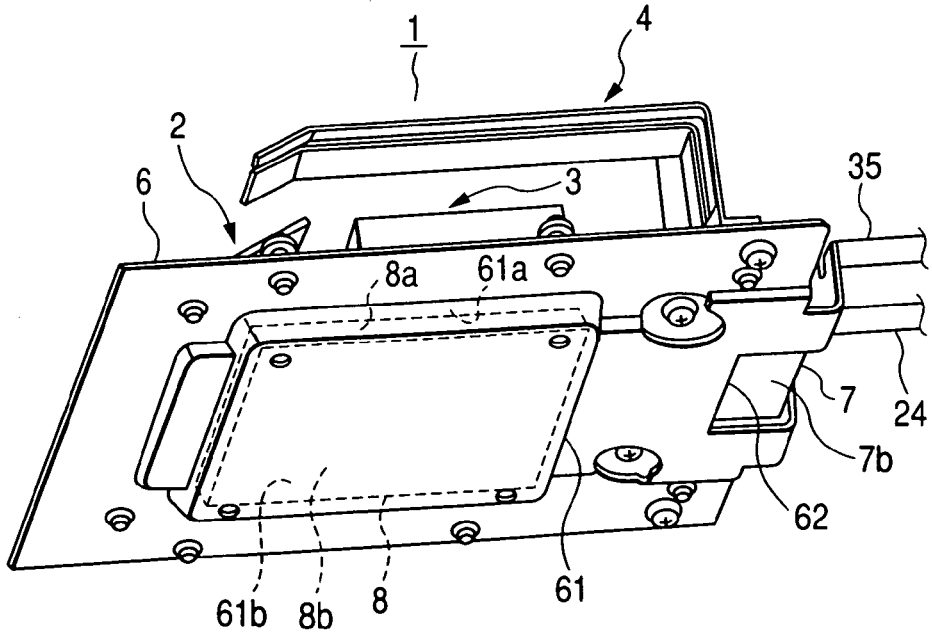
FIG. 2 is another perspective view of the vehicle-installed integrated antenna viewed from below.
Figure 3:
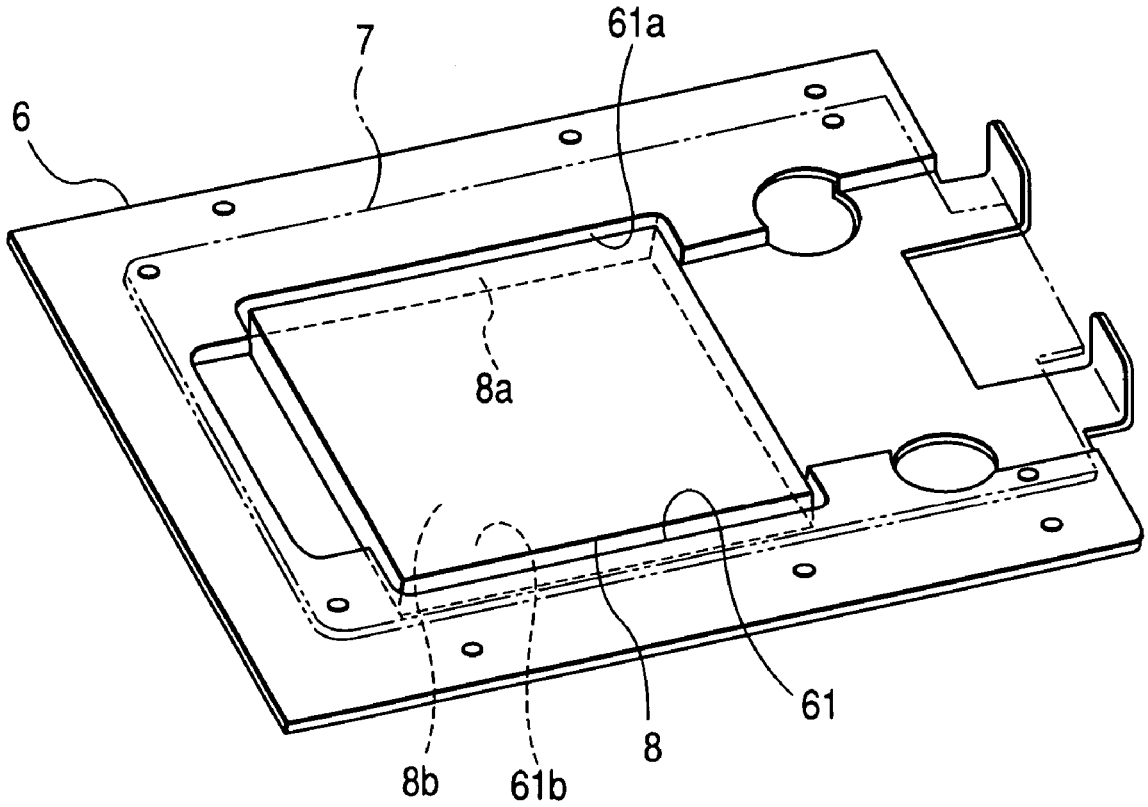
FIG. 3 is a partial perspective view of the vehicle-installed integrated antenna showing a telephone transceiver housed in a recess formed in a ground plate of the vehicle-installed integrated antenna.

FIG. 2 is a perspective view of the vehicle-installed integrated antenna 1 viewed from below. As shown in this figure, the ground plate 6 has a roughly rectangular recess 61 for housing the telephone transceiver 8 secured to the rear surface 7*b* of the circuit board 7 which is screwed to a front surface 6*a* of the ground plate 6. The size of the recess 61 is made very slightly larger than that of the telephone transceiver 8, so that side surfaces 8*a* of the telephone transceiver 8 are very close to inner side surfaces 61*a* of the recess 61, and a bottom surface 8*b* of the telephone transceiver 8 is very close to an inner bottom surface 61*b* of the recess 61.

The ground plate 6 has also a notch 62 through which part of the rear surface 7*b* of the circuit board 7 is exposed. Although not shown in FIG. 2, there is mounted, on this exposed part, a connector to which cables for connecting the circuit board 7 to a handset (not shown) for the automobile telephone system and for supplying electricity to the circuit board 7 are connected.

Since the telephone transceiver 8 secured to the rear surface 7*b* of the circuit board 7 is housed in the recess 61 formed in the ground plate 6, and the heat emitted from the telephone transceiver 8 is therefore dissipated through the ground plate 6, it becomes unnecessary to provide any heat radiating member or heat radiation fin. Furthermore, the noise emitted from the telephone transceiver 8 can be prevented from leaking to the outside, because the telephone transceiver 8 is enclosed by the inner surfaces of the recess 61 and the rear surface 7*b* of the circuit board 7.

Although the ground plate 6 has the irregular surface because of the recess 61 formed therein, it does not cause any adverse effects in terms of transmission and reception of radio-frequency signals, and there is no fear that the antenna characteristics degrade.

The vehicle-installed integrated antenna 1 of this embodiment requires the ground plate 6 to have a substantial size, because it includes the ETC antenna element 2, the GPS/VICS antenna element 3, and the telephone antenna elements 4, 5. Conversely, the large size of the ground plate 6 makes it possible to form the recess 61 therein, and to utilize the space below these antenna elements, thereby compacting the vehicle-installed integrated antenna 1.

As explained above, in the vehicle-installed integrated antenna 1 of this embodiment, the ground plate 6 serves as not only a plane for grounding the ETC antenna element 2, the GPS/VICS antenna element 3 and the telephone antenna elements 4, 5, but also a radiator for dissipating the heat emitted from the telephone transceiver 8. Accordingly, this vehicle-installed integrated antenna 1 can be constituted by a smaller number of parts, thereby reducing the production costs thereof.

Furthermore, in the vehicle-installed integrated antenna 1 of this embodiment, the noise emitted from the telephone transceiver 8 can be prevented from leaking to the outside, because the telephone transceiver 8 is housed in a shielded state.

Although the above described embodiment concerns a vehicle-installed integrated antenna, the present invention is applicable to any indoor or outdoor integrated antenna. The present invention is also applicable to an antenna including a single antenna element.

The above explained preferred embodiments are exemplary of the invention of the present application which is described solely by the claims appended below. It should be understood that modifications of the preferred embodiments may be made as would occur to one of skill in the art.

What is claimed is:

1. A transceiver-integrated antenna comprising:

an antenna element;

a ground plate for grounding said antenna element;

a transceiver configured to transmit and receive radio signals through said antenna element; and a circuit board having a first surface on which said transceiver is mounted;

wherein said transceiver is housed in a recess formed in said ground plate, said transceiver being enclosed by an inner surface of said recess, said antenna element being located on a second surface of said circuit board, said second surface being opposite to said first surface.

2. The transceiver-integrated antenna according to claim 1, further comprising a circuit board on a front surface of which electronic components for processing transmit signals to be supplied to said transceiver and receive signals supplied from said transceiver are mounted, said circuit board being secured to a front surface of said ground plate, said transceiver being secured to a rear surface of said circuit board.

3. The transceiver-integrated antenna according to claim 1, wherein said antenna element includes a conductive bar plate secured to said ground plate at one end thereof, and fed by said transceiver.

4. The transceiver-integrated antenna according to claim 1, wherein said recess formed in said ground plate is a closed recess.

5. The transceiver-integrated antenna according to claim 1, wherein said transceiver is a generally rectangular component and all four sides of said transceiver being adjacent a portion of said ground plate forming said recess.

6. The transceiver-integrated antenna according to claim 1, wherein said recess defines a continuous circumferential inner side surface, an entire circumferential outer surface of said transceiver being disposed adjacent said continuous circumferential inner side surface of said recess.

7. A transceiver-integrated antenna comprising:

a first antenna element;

a second antenna element connectable to one of an external receiver and an external transceiver;

a ground plate for grounding said first and second antenna elements;

a transceiver configured to transmit and receive radio signals through said first antenna element; and a circuit board having a first surface on which said transceiver is mounted;

wherein said transceiver is housed in a recess formed in said ground plate, said transceiver being enclosed by an inner surface of said recess, said first and second antenna elements being located on a second surface of said circuit board, said second surface being opposite to said first surface.

8. The transceiver-integrated antenna according to claim 7, further comprising a circuit board on a front surface of which electronic components for processing transmit signals to be supplied to said transceiver and receive signals supplied from said transceiver are mounted, said circuit board being secured to a front surface of said ground plate, said transceiver being secured to a rear surface of said circuit board.

9. The transceiver-integrated antenna according to claim 7, wherein said first antenna element includes a conductive bar plate secured to said ground plate at one end thereof, and fed by said transceiver.

10. The transceiver-integrated antenna according to claim 7, wherein said second antenna element includes a rectangular electrode formed on a parallelepiped dielectric in electrical contact with said ground plate.

11. The transceiver-integrated antenna according to claim 7, wherein said recess formed in said ground plate is a closed recess.

12. The transceiver-integrated antenna according to claim 7, wherein said transceiver is a generally rectangular component and all four sides of said transceiver being adjacent a portion of said ground plate forming said recess.

13. The transceiver-integrated antenna according to claim 7, wherein said recess defines a continuous circumferential inner side surface, an entire circumferential outer surface of said transceiver being disposed adjacent said continuous circumferential inner side surface of said recess.

* * * * *